US011788199B2

(12) United States Patent
Wijenberg et al.

(10) Patent No.: US 11,788,199 B2
(45) Date of Patent: Oct. 17, 2023

(54) METHOD FOR ELECTROLYTICALLY DEPOSITING A CHROMIUM OXIDE LAYER

(71) Applicant: TATA STEEL IJMUIDEN B.V., Velsen-Noord (NL)

(72) Inventors: Jacques Hubert Olga Joseph Wijenberg, Amsterdam (NL); Arnoud Cornelis Adriaan De Vooys, Maarssen (NL); Mark Willem Litz, Aerdenhout (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 0 days.

(21) Appl. No.: 17/433,141

(22) PCT Filed: Feb. 25, 2020

(86) PCT No.: PCT/EP2020/054925

§ 371 (c)(1),
(2) Date: Aug. 23, 2021

(87) PCT Pub. No.: WO2020/173950

PCT Pub. Date: Sep. 3, 2020

(65) Prior Publication Data

US 2022/0154360 A1 May 19, 2022

(30) Foreign Application Priority Data

Feb. 25, 2019 (EP) ..... 19159093
Nov. 18, 2019 (EP) ..... 19209861

(51) Int. Cl.
*C25D 9/10* (2006.01)
*C25D 17/10* (2006.01)
*C25D 3/06* (2006.01)

(52) U.S. Cl.
CPC ..... *C25D 9/10* (2013.01); *C25D 17/10* (2013.01); *C25D 3/06* (2013.01)

(58) Field of Classification Search
CPC ..... C25D 9/10
See application file for complete search history.

(56) References Cited

U.S. PATENT DOCUMENTS 6,004,448 A * 12/1999 Martyak ..... C25D 9/08 205/319
6,099,714 A * 8/2000 Bibber ..... C25D 3/06 205/243
2016/0138178 A1* 5/2016 Wijenberg ..... C25D 5/12 205/199

FOREIGN PATENT DOCUMENTS

WO 2012045791 A1 4/2012
WO 2014202316 A1 12/2014
WO WO-2017174345 A1 * 10/2017 ..... B32B 15/08
(Continued)

OTHER PUBLICATIONS

International Search Report and Written Opinion dated May 26, 2020 for PCT/EP2020/054925 to Tata Steel Ijmuiden B.V. filed Feb. 25, 2020.

*Primary Examiner* — Hosung Chung
(74) *Attorney, Agent, or Firm* — Vorys, Sater, Seymour and Pease LLP

(57) ABSTRACT

A method for electrolytically depositing a chromium oxide layer onto i) blackplate or onto ii) blackplate coated with a chromium electrodeposited coating produced based on chromium(III) technology electroplating, and to the coated product obtained thereby.

20 Claims, 5 Drawing Sheets a.

b.

(56) References Cited

FOREIGN PATENT DOCUMENTS

WO WO-2018077874 A1 * 5/2018 ..... C22C 19/03

* cited by examiner

METHOD FOR ELECTROLYTICALLY DEPOSITING A CHROMIUM OXIDE LAYER

CROSS-REFERENCE TO RELATED APPLICATIONS

This is a § 371 National Stage Application of International Application No. PCT/EP2020/054925 filed on Feb. 25, 2020, claiming the priority of European Patent Application No. 19159093.4 filed on Feb. 25, 2019 and European Patent Application No. 19209861.4 filed on Nov. 18, 2019.

FIELD OF THE INVENTION

This invention relates to a method for electroplating a steel strip with a plating layer and an improvement thereof.

BACKGROUND OF THE INVENTION

Tin mill products traditionally include electrolytic tinplate, electrolytic chromium coated steel (also referred to as tin free steel or TFS), and blackplate. Although not limited by it, most applications for tin mill products are used by the container industry in the manufacturing of cans, ends and closures for the food and beverage industry.

In continuous steel strip plating, a cold-rolled steel strip is provided which is usually annealed after cold-rolling to soften the steel by recrystallisation annealing or recovery annealing. After the annealing and before plating the steel strip is first cleaned for removing oil and other surface contaminants. After the cleaning step, the steel strip is pickled in a sulphuric or hydrochloric acid solution for removing the oxide film. Between different treatment steps the steel strip is rinsed to prevent contamination of the solution used for the next treatment step. During rinsing and transport of the steel strip to the plating section a fresh thin oxide layer is formed instantly on the bare steel surface. The bare steel surface needs to be protected against further oxidation by depositing a coating layer onto the steel.

One such protection is provided by a process used in electroplating called electrodeposition. The part to be plated (the steel strip) is the cathode of the circuit. The anode of the circuit may be made of the metal to be plated on the part (dissolving anode, such as those used in conventional tinplating) or a dimensionally stable anode (which does not dissolve during plating). The anode and cathode are immersed in an electrolyte solution containing ions of the metal to be deposited onto the blackplate substrate.

Blackplate is a tin mill product which has not (yet) received any metallic coating during production. It is the basic material to produce other tin mill products. Blackplate may be single reduced or double reduced. For a single reduced blackplate a hot-rolled strip is reduced to the desired thickness in a cold rolling mill and subsequently recrystallisation or recovery annealed in a continuous or batch annealing process, and optionally temper rolled. For a double reduced blackplate the single rolled substrate is subjected to a second rolling reduction of more than 5%. A temper rolled single reduced blackplate is generally not seen as a double reduced blackplate because the temper rolling reduction is below 5%.

The SR or DR blackplate is usually provided in the form of a coiled strip.

TCCT® (Trivalent Chromium Coating Technology) is a REACH compliant alternative for Electrolytic Chromium Coated Steel (ECCS) ECCS is a SR or DR blackplate coated by electrolytic deposition with metallic chrome overlaid with a film of chrome oxide. This type of coated steel has always been produced based on technology using harmful Cr(VI)-compounds. REACH, the European Union regulation on chemicals, bans the use of these hexavalent chromium compounds. Consequently, over time alternatives have been developed based on harmless compounds. TCCT® was developed by Tata Steel based on harmless Cr(III) technology. WO2014202316-A1 discloses a Cr(III)-electrolyte using 120 g/l basic chromium(III)sulphate although this substrate already possesses a better performance compared to other alternatives and has a performance comparable to ECCS, the adhesion between the TCCT-substrate and organic coatings needs further improvement.

OBJECTIVES OF THE INVENTION

It is the object of the invention to deposit a chromium oxide layer from an electrolyte solution comprising a trivalent chromium compound on a metal strip.

It is also an object of the invention to provide a REACH compliant alternative for the Cr(VI) based treatment that improves lacquer adhesion to Cr-plated blackplate.

DESCRIPTION OF THE INVENTION

One or more of the objects is reached with a method according to a method for electrolytically depositing a chromium oxide layer onto a blackplate or onto blackplate coated with a chromium electrodeposited coating produced based on chromium(III) technology. The deposition of the chromium oxide layer is performed in a continuous high-speed plating line operating at a line speed of at least 50 m/min from a halide-ion free aqueous electrolyte solution comprising a trivalent chromium compound provided by a water-soluble chromium(III) salt. The blackplate or the coated blackplate acts as a cathode. An anode is provided that comprises a catalytic coating of i). iridium oxide or ii). a mixed metal oxide comprising iridium oxide and tantalum oxide, for reducing or eliminating the oxidation of $Cr^{3+}$-ions to $Cr^{6+}$-ions, and wherein the electrolyte solution contains at least 50 mM and at most 1000 mM $Cr^{3+}$-ions, a total of from 25 to 2800 mM of sodium sulphate or potassium sulphate, a pH of between 2.50 and 3.6 measured at 25° C., and wherein the plating temperature is between 40 and 70° C. and wherein no other compounds are added to the electrolyte, except optionally sulphuric acid or sodium hydroxide or potassium hydroxide to adjust the pH to the desired value. Additionally, there may be only unavoidable impurities in the electrolyte.

For the sake of clarity, it is noted that 1 mM means 1 millimole/l. It should also be noted that there are two potential sources of sodium sulphate in the electrolyte. Firstly, if basic chromium sulphate is used as the water-soluble chromium (III) salt, of which the chemical formula is $(CrOHSO_4)_2$x $Na_2SO_4$, then for each mM of Cr 0.5 mM of $Na_2SO_4$ is added as well to the electrolyte. However, $Na_2SO_4$ can also be added as a salt separately, e.g. as a conductivity enhancing salt or to increase the kinematic viscosity of the electrolyte. The total amount of $Na_2SO_4$ is the sum of the addition of the $Na_2SO_4$ and the amount that comes along with the basic chromium (III) sulphate. If no basic chromium sulphate is used as the water-soluble chromium (III), but for instance chromium(III) sulphate or chromium(III) nitrate, then any $Na_2SO_4$ present in the electrolyte was added as sodium sulphate. The above Cr(III) salts, including basic chromium(III) sulphate may be provided alone or in combination.

Steel substrate in the sense of the invention intends to mean the steel basis including the metallic layers (if any) that have been deposited thereupon prior to depositing the chromium oxide layer according to the invention.

The absence of a complexing agent in the electrolyte means that an essential component for depositing Cr-metal is absent. The complexing agent is required for destabilising the very stable $[Cr(H_2O)_6]^{3+}$ complex. The inventors surprisingly found that by avoiding the use of a complexing agent (e.g. NaCOOH) the deposition of chromium metal is prevented but instead a closed layer of chromium oxide is deposited. chr Moreover, the absence of the carbon-containing complexing agent also prevented the co-deposition of chromium carbide in the oxide layer. Any residual amounts of chromium carbide, if present in detectable amounts in the oxide layer, are therefore the result of minute and inevitable amounts of residual other compounds present in the base material to produce the electrolyte. The presence of sulphate in the electrolyte causes the presence of sulphate in the chromium oxide coating layer under the plating conditions according to the invention. The maximum amount of sulphate detected at the surface is about 10%. The minimum amount of sulphate at the surface is 0.5%, and in most cases at least 2%. These values were derived from XPS depth profiles over the first 3 nm starting at the outer surface.

Because of the closed layer of chromium oxide onto the substrate the adhesion between the substrate upon which the closed layer of chromium oxide is deposited and an organic coating layer is much improved.

If the pH of the electrolyte solution becomes too high or too low, then sulphuric acid or sodium hydroxide may be added to adjust the pH to a value inside the desired range. Also, different acids or bases may be used, but in view of the simplicity of the bath chemistry sulphuric acid and sodium hydroxide are preferable.

Sodium sulphate or potassium sulphate also acts as a conductivity enhancing salt. To keep the electrolyte as simple as possible, and to prevent the formation chlorine or bromine, the conductivity enhancing salt is a sulphate-salt. The cation is preferably sodium or potassium. For the electrolyte not to become too viscous, a maximum amount of 2800 mM of sodium—or potassium sulphate is still allowable. For reasons of simplicity the cation is preferably sodium. A pH over 4 results in a colloidal reaction in the electrolyte rendering it unusable for electroplating. A pH below 2.50 is undesirable because the increase of surface pH at the cathode needed to deposit the chromium-oxide (CrOx) cannot be obtained at these low pH values in the electrolyte. The high pH also enable the use of lower current densities during deposition, resulting in less hydrogen evolution. Excessive hydrogen evolution is believed to be causing the stripy appearance of the surface at lower pH (below 2.50). The relatively high electrolyte temperature electrolyte of at least 40° C. also allows using a lower current density, thereby also helping to reduce hydrogen evolution.

Preferably only sodium sulphate is used in the electrolyte, because it keeps the electrolyte's composition as simple as possible.

Halide ions, such as chloride ions or bromide ions, may not be present in the electrolyte. This absence is needed to prevent formation of (e.g.) chlorine or bromine at the anode. The electrolyte also does not contain a depolarizer. In many similar baths, potassium bromide is used as depolarizer. The absence of this compound mitigates any risk of bromine formation at the anode. Also, a buffering agent, such as the often-used boric acid ($H_3BO_3$), is not present in the electrolyte.

It is essential in the method according to the invention that the anode comprises i). a catalytic coating of iridium oxide or ii). a mixed metal oxide comprising iridium oxide and tantalum oxide. The catalytic coating is generally deposited onto a titanium anode, wherein the coverage of the titanium is such that titanium is not exposed to the electrolyte. The use of any other practical anode, such as platinum, platinised titanium or nickel-chromium, was found to result in the formation of $Cr^{6+}$-ions which is to be avoided because of the toxic and carcinogenic nature of Cr(VI) compounds. Carbon as anode material disintegrates over time because of the high current densities used in the industrial high-speed plating lines and should also not be used.

In the method according to the invention the steel substrate is blackplate or blackplate coated with a chromium electrodeposited coating produced based on chromium(III) technology such as TCCT (See FIG. 3).

The steel used for blackplate can be any steel grade suitable for producing packaging steel. By means of example, but not intended to be limited by this, reference is made to the steel grades for packaging applications in EN10202:2001 and ASTM 623-08:2008.

The blackplate is usually provided in the form of a strip of low carbon (LC), extra low carbon (ELC) or ultra-low carbon (ULC) with a carbon content, expressed as weight percent, of between 0.05 and 0.15 (LC), between 0.02 and 0.05 (ELC) or below 0.02 (ULC) respectively. Alloying elements like manganese, aluminium, nitrogen, but sometimes also elements like boron, are added to improve the mechanical properties (see EN10202, 10205 and 10239). The blackplate may consist of an interstitial-free low, extra-low or ultra-low carbon steel, such as a titanium stabilised, niobium stabilised or titanium-niobium stabilised interstitial-free steel.

Single reduced (SR) blackplate, as defined in international standards, falls within the range 0.15 mm to 0.49 mm; double reduced (DR) blackplate from 0.13 mm to 0.29 mm, the typical range for DR being 0.14-0.24 mm. Lower gauges down to 0.08 mm are now available for special uses, either in single- or double-reduced base materials.

TCCT is based on the deposition of a chromium based layer which consists of chromium oxide and chromium metal as well as some chromium carbide and some chromium sulphate. This layer is deposited in a one-step process, and therefore the conditions are optimised for depositing Cr-metal (Cr) and Cr-oxide (CrOx) simultaneously. In such a deposited layer the oxide is distributed in the layer, and not exclusively on top of the layer. There is no closed oxide layer, i.e. an oxide layer covering the entire surface of the substrate, present at the surface. Although there is an advantage in the simplicity of the one-step process according to WO2014202316-A1, the inventors found that by applying a Cr-CrOx layer according to according WO2014202316-A1 followed by depositing a chromium oxide layer onto the Cr-CrOx (and optionally containing chromium sulphate and/or chromiumcarbide as well) from a separate electrolyte according to the invention, allowed a better control of the oxide layer, allowed to deposit a closed oxide layer, and allowed to improve the performance of the oxide layer in terms of improving the adhesion to organic coatings. The absence of the complexing agent means that no or only a very small amount of metallic chromium is codeposited.

The method according to the invention also allows the deposition of a closed chromium oxide layer directly on top of blackplate. Although the corrosion protection of the layer is limited, the adhesion of an organic coating to the blackplate is much improved, and this would allow the application of a lacquer or a polymer film to the blackplate. This material would be suitable for applications where an extreme corrosion resistance is not needed, e.g. for some non-food applications.

So, although the substrates may be different, the effect of the closed chromium oxide layer deposited on the substrate, in each case, results in an improvement of the adhesion between the substrate and organic coatings.

Preferable embodiments are provided in the dependent claims.

As the water soluble chromium (III) salt one or more salts is selected from the group of salts consisting of basic chromium(III) sulphate, chromium(III) sulphate and chromium(III) nitrate. The use of only basic chromium(III) sulphate is preferable from the point of view of keeping the bath chemistry as simple as possible.

In an embodiment the electrolyte solution contains at most 500 mM of $Cr^{3+}$-ions, preferably at most 350 mM, more preferably at most 250 mM or even at most 225 mM of $Cr^{3+}$-ions. The electrolyte solution preferably contains at least 100 mM of $Cr^{3+}$-ions, preferably at least 125 mM of $Cr^{3+}$-ions. These preferred ranges provide good results.

In a preferable embodiment the pH of the electrolyte is between 2.50 and 3.25 measured at 25° C. Preferably the plating temperature is between 40 and 65° C. In an embodiment the pH of the electrolyte solution is at most 3.30, preferably at most 3.00. In an embodiment the pH is at least 2.60 or even at least 2.70. The pH range between 2.55 and 3.25 provided excellent results in terms of coating quality. Also, above the value of 3.25 the risk of a colloidal reaction in the electrolyte rendering it unusable for electroplating is non-existent in the method according to the invention. In the pH range between 3.25 and 4 the risk increases from acceptable just over 3.25 to unacceptable if the pH is above 4. Below 2.55 the process becomes less economical because the effort required to increase the surface pH at the cathode is larger at lower pH.

The plating time, i.e. the duration of the application of electrical current to the cathode, which is considerably shorter than the immersion time, is preferably as short as possible to allow use of the method in an industrial line. At low line speeds and/or long anode lengths, the plating time is at most 3 seconds. A maximum plating time of at most 1000 ms is still allowable, preferably at most 900 ms. At very high line speeds the current density and/or the total anode length may need to be increased to keep the line at a practical minimum. Although in the method according to the invention it is preferable that no complexing agent whatsoever is present in the electrolyte, it may nevertheless occur that, despite all due care and use of intermediate rinsing baths, minute amounts are unavoidably present as inevitable impurities in the electrolyte as a result of drag-in from previous upstream electrolyte baths in the plating line. An allowable maximum is 10 mM of complexing agent, such as NaCOOH, preferably at most 5 mM, preferably at most 2 mM. These amounts were found not to result in the deposition of chromium metal of any significance and the quality of the deposited oxide layer adhesion appeared unaffected. Nevertheless it is preferable that no such complexing agent is present in the electrolyte for the method according to the invention.

In an embodiment the electrolyte solution contains at least 210 mM and/or at most 845 mM of sodium sulphate.

In a preferred embodiment the plating temperature is at least 50° C., preferably at least 55° C.

In an embodiment the line speed of the continuous plating line is at least 100 m/min, more preferably at least 200 m/min.

In a preferred embodiment the aqueous electrolyte consists only of basic chromium(III) sulphate, sodium sulphate and optionally sulphuric acid or sodium hydroxide in an amount sufficient to adjust the pH of the electrolyte to the desired value and inavoidable impurities. Preferably the pH is adjusted to a value of 2.55 or more, and preferably to a value of 3.25 or less.

In a preferable embodiment the blackplate, prior to being provided with the oxide layer according to the method of the invention, is precoated with a metallic coating layer on one or both sides, said coating layer(s) comprising chromium metal and chromium oxide, and optionally also one or more of chromium carbide and chromium sulphate, and wherein the metallic coating layer is deposited from an electrolyte solution comprising a water soluble chromium(III) salt, wherein the electrolyte solution is free of chloride ions and of a boric acid buffering agent, the electrically conductive substrate acts as a cathode and an anode comprising a catalytic coating of iridium oxide or a mixed metal oxide (such as a mixed metal oxide comprising iridium oxide and tantalum oxide), for reducing or eliminating the oxidation of $Cr^{3+}$-ions to $Cr^{6+}$-ions, wherein the electrolyte solution contains at least 50 mM and at most 1000 mM $Cr^{3+}$-ions (=52 g/l Cr(III)), a complexing agent at a $$\left(\frac{\text{complexing agent}}{Cr^{3+}}\right)$$

molar ratio of at least 1:1, preferably at least 1.5:1 and more preferably at least 2:1 and wherein the formate/$Cr^{3+}$ molar ratio is at most 2.5:1, 1 to 2800 mM (=398 g/l) of sodium sulphate ($Na_2SO_4$), a pH of between 1.5 and 3.6 measured at 25° C., and wherein the plating temperature is between 30 and 70° C. Good results were obtained for a Cr(III) of 40 g/l, at a formate/$Cr^{3+}$ ratio of 2.0 and a plating temperature of 45° C. It is preferable for the plating temperature to be at least 35° C. and at most 55° C., more preferably at most 50° C. The formate-ion is needed as a complexing agent to deposit the Cr-metal and the ratio of at most 2.5:1 has proven to be sufficient in most cases. Preferably the the electrolyte solution contains at least 50 mM and most 750, more preferably at most 500 and most preferably at most 250 mM $Cr^{3+}$-ions.

With a higher Cr(III) content the stability of the plating process of the Cr-metal layer increases. The plating window in terms of current density is also larger at higher concentrations. Also, a higher formate/Cr ratio increases the plating window. The plating temperature also influences the efficiency in that the current density needed to deposit a set amount of Cr (in $mg/m^2$) is lower. Process robustness in terms of sensitivity to fluctuations becomes less at higher Cr(III) concentration and higher formate/Cr ratio.

In a preferable embodiment the pH of the electrolyte is between 1.5 and 3.6 measured at 25° C. In an embodiment the pH of the electrolyte solution is at most 3.30, preferably at most 3. In an embodiment the pH is at least 2.00, preferably at least 2.50, even more preferably at least 2.60 or even at least 2.70. The pH range between 2.55 and 3.25 provided excellent results in terms of coating quality. A pH of about 2.9 appeared to result in the optimal plating window.

In an embodiment blackplate, optionally precoated with the aforementioned coating layer(s) comprising chromium metal, chromium oxide, chromium carbide and chromium sulphate, and provided with the chromium oxide layer applied with the method according to the invention is further coated on one or both sides by a film lamination step or a direct extrusion step, with an organic coating consisting of a thermoplastic single layer, or a thermoplastic multi-layer polymer, preferably wherein the thermoplastic polymer coating is a polymer coating system comprising one or more layers comprising thermoplastic resins such as polyesters or polyolefins, acrylic resins, polyamides, polyvinyl chloride, fluorocarbon resins, polycarbonates, styrene type resins, ABS resins, chlorinated polyethers, ionomers, urethane resins and functionalised polymers; and/or copolymers thereof; and or blends thereof.

Preferably the thermoplastic polymer coating is a polymer coating system that comprises one or more layers of thermoplastic resins such as polyesters or polyolefins, but can also include acrylic resins, polyamides, polyvinyl chloride, fluorocarbon resins, polycarbonates, styrene type resins, ABS resins, chlorinated polyethers, ionomers, urethane resins and functionalised polymers. For clarification:

Polyester is a polymer composed of dicarboxylic acid and glycol. Examples of suitable dicarboxylic acids include therephthalic acid, isophthalic acid (IPA), naphthalene dicarboxylic acid and cyclohexane dicarboxylic acid. Examples of suitable glycols include ethylene glycol, propane diol, butane diol, hexane diol, cyclohexane diol, cyclohexane dimethanol (CHDM), neopentyl glycol etc. More than two kinds of dicarboxylic acid or glycol may be used together.

Polyolefins include for example polymers or copolymers of ethylene, propylene, 1-butene, 1-pentene, 1-hexene or 1-octene.

Acrylic resins include for example polymers or copolymers of acrylic acid, methacrylic acid, acrylic acid ester, methacrylic acid ester or acrylamide.

Polyamide resins include for example so-called Nylon 6, Nylon 66, Nylon 46, Nylon 610 and Nylon 11.

Polyvinyl chloride includes homopolymers and copolymers, for example with ethylene or vinyl acetate. Fluorocarbon resins include for example tetrafluorinated polyethylene, trifluorinated monochlorinated polyethylene, hexafluorinated ethylene-propylene resin, polyvinyl fluoride and polyvinylidene fluoride.

Functionalised polymers for instance by maleic anhydride grafting, include for example modified polyethylenes, modified polypropylenes, modified ethylene acrylate copolymers and modified ethylene vinyl acetates.

Mixtures of two or more resins can be used. Further, the resin may be mixed with anti-oxidant, heat stabiliser, UV absorbent, plasticiser, pigment, nucleating agent, antistatic agent, release agent, anti-blocking agent, etc. The use of such thermoplastic polymer coating systems has shown to provide excellent performance in can-making and use of the can, such as shelf-life.

Preferably the thermoplastic polymer coating is a polymer coating system comprising one or more layers comprising thermoplastic resins such as polyesters or polyolefins, acrylic resins, polyamides, polyvinyl chloride, fluorocarbon resins, polycarbonates, styrene type resins, ABS resins, chlorinated polyethers, ionomers, urethane resins and functionalised polymers; and/or copolymers thereof; and or blends thereof.

Preferably the thermoplastic polymer coating on the one or both sides of the coated blackplate is a multi-layer coating system, said coating system comprising at least an adhesion layer for adhering to the coated blackplate, a surface layer and a bulk layer between the adhesion layer and the surface layer, wherein the layers of the multi-layer coating system comprise or consist of polyesters, such as polyethylene terephthalate, Isophthalic acid (IPA)-modified polyethylene terephthalate, cyclohexanedimethanol (CHDM)-modified polyethylene terephthalate, polybutylene terephthalate, polyethylene naphtha late, or copolymers or blends thereof.

The application process of the thermoplastic polymer coating is preferably performed by laminating a polymer film onto the coated blackplate by means of extrusion coating and lamination, wherein a polymer resin is melted and formed into thin hot film, which is coated onto the moving substrate. The coated substrate then usually passes between a set of counter-rotating rolls, which press the coating onto the substrate to ensure complete contact and adhesion. The alternative is film lamination, where a film of the polymer is supplied and coated onto a heated substrate and pressed onto the substrate by and between a set of counter-rotating rolls to ensure complete contact and adhesion.

EXAMPLES

As substrates the materials according to table 1 were used.

TABLE 1

Substrates.

| FIG. 2 | material | Cr(ΔXRF) mg $m^{-2}$ |
|---|---|---|
| 1 | blackplate (uncoated mild steel) | n.a. |
| 2 | TCCT | 0.4 |

TABLE 2

Cr(III) electrolyte compositions

| component | unit | 1 | Ref (sample E) |
|---|---|---|---|
| Cr(III) concentration | g $l^{-1}$ | 20 | 20 |
| additional sodium sulphate | g $l^{-1}$ | 0 | 42 |
| complexing agent | g $l^{-1}$ | 0 | 39 (NaCOOH) |

In FIG. 2 results of RCE experiments are presented. Electrolyte 1 was used (20 g/l basic chromium(III) sulphate. The experiments were performed on a rotating cylinder electrode at 776 rpm at 55° C. and a pH of 2.7. 776 rpm corresponds to 100 m/s line speed in an industrial coating line. For the electrodeposition experiments titanium anodes with a catalytic mixed metal oxide coating of iridium oxide and tantalum oxide were used. The rotational speed of the RCE was kept constant at 776 RPM ($\Omega^{0.7}$ =6.0 $s^{0.7}$). The substrates are listed in table 1 and the dimensions of the cylinder were 113.3 mm×Ø73 mm. The plating time was 800 ms. In FIG. 2 the CrOx-coating weight (expressed as Cr metal in mg $m^{-2}$) is plotted as a function of current density for blackplate (1) and TCCT (2). In the figure the Cr-coating weight is plotted as a function of current density. For sample 1 no CrOx was present on the fresh substrate prior to coating the substrate with the method according to the invention.

The amount of Cr deposited is plotted on the Y-axis. The circles in the plot show the amount of Cr-oxide. The amount of Cr-oxide is determined by means of XRF. The XRF-measurement is performed as described in the aforecited paper, which is included herein by reference. By first measuring the sample with XRF a base value of total deposited chromium is measured (i.e. metal, oxide, sulphate and (if present) carbide). After that the sample is exposed to a hot (90° C.) concentrated (300 g $l^{-1}$) sodium hydroxide solution for 10 minutes, which dissolves all Cr-oxides and a second XRF-measurement is performed. The difference (Δ(XRF)) is then attributed to Cr-oxides, and that is the value plotted in FIG. 2.

TABLE 3

Details for RCE experiments potted in FIG. 6.

| # | symbol | substrate | pre-treatment | Colour oxide layer |
|---|---|---|---|---|
| 1 | ● | BP | degreasing & pickling | greyish |
| 2 | ● | BP | degreasing & pickling | greyish |
| 3 | ● | BP | degreasing & pickling | greyish |
| 4 | ■ | TCCT | degreasing | goldish |

The RCE results match very well with the results of coil trials in an industrial size pilot line ('4' in FIG. 2) with the following settings: 14 g/l Cr, T=55° C., line speed=150 m/min[1], Current density=18.75 A $dm^{-2}$, plating time: 600 ms, even though the Cr(III) concentration was slightly lower. It was also found that the pre-treatment of the strip had little influence on the amount of CrOx that was deposited onto the strip.

Similar experiments performed at pH values below 2.50, such as those disclosed in U.S. Pat. No. 6,099,714 showed an unsatisfactory stripy surface quality when performed in an industrial production line on blackplate or a steel substrate comprising a metallic coating layer on one or both side, wherein said coating layer(s) comprise(s) chromium metal and chromium oxide. U.S. Pat. No. 6,099,714 discloses experiments based on 3×5 $inch^2$ tinplate samples, i.e. in a laboratory setting and intended for piecemeal plating, and on a different substrate than in the method according to the invention. Apart from the aesthetically unattractive appearance that may put of customers, the stripes may also result in uneven oxide layer thickness and/or composition which may affect the performance of the coated blackplate as a whole.

TABLE 4

Influence of pre-treatment on amount of Cr deposited as CrOx onto TCCT.

| Pre-treatment | Avg Cr (mg $m^{-2}$) |
|---|---|
| None | 21.3 |
| Pickling | 20.7 |
| Pickling and degreasing | 18.8 |

The ΔXRF results are almost the same for the various pre-treatments, so that the amount of Cr as CrOx is hardly affected by the type of pre-treatment of the substrate before depositing the chromium oxide layer according to the invention.

Sterilisation trials were performed using a blackplate, precoated with a coating layer comprising chromium metal and chromium oxide (and optionally also one or more of chromium carbide and chromium sulphate) deposited from an electrolyte with a complexing agent (i.e. TCCT), and further provided with the chromium oxide layer applied with the method according to the invention, i.e. deposited from an electrolyte without a complexing agent. The blackplate is therefore provided with a Cr-CrOx layer first and then with a CrOx coating. This coated blackplate is further coated on both sides by a film lamination step with PET or PP on the side which is to become the inside of a DRD can. The performance is compared to a conventional ECCS (based on Cr(VI) technology). The steel blackplate was, in all cases, a 0.223 mm thick, continuously annealed SR low carbon steel (TH340, 0.045% wt.C, 0.205 wt. % Mn, 0.045% wt. % Al_sol)).

The following combinations were tested (all polymers are 3-layer systems comprising an adhesion layer, a bulk layer and a top layer). "Int" means the side that becomes the interior of the can:

A. PET coated TCCT®: Int & Ext:20 μm PET
B. PP coated TCCT®: Int:40 μm PP/Ext:20 μm PET
C. PET ECCS reference: Int & Ext: 20 μm PET
D. PP ECCS reference: Int:40 μm PP/Ext:20 μm PET
E. TCCT® reference: Int & Ext: 20 μm PET Sample E was a TCCT variant without the additional CrOx layer deposited according to the invention. Sample C and D are the conventional reference ECCS (Cr(VI)-technology) samples. Samples A and B are TCCT variants with the additional CrOx layer deposited according to the invention. The amount of chromium oxides deposited according to the invention on sample A and B (expressed as Cr in $mg/m^2$) is 10 $mg/m^2$. The TCCT coating and the oxide coating were both applied in an industrial plating line. The polymers layers were laminated onto the metal substrates by film lamination including a high temperature post-heat and water quench in an industrial lamination line. Standard two-piece DRD (300 ml, 65 mm Ø) cans were produced from these materials.

TABLE 5

The test conditions were as follows:

| Medium | Conditions | Direct opening | 2 weeks opening |
|---|---|---|---|
| 3.6% NaCl with scratch | 121° C. 60 min. | 5 cans | — |
| 3.6% NaCl aerated | 121° C. 60 min. | 10 cans | — |
| 3.6% NaCl + 1 g/l vitamin C | 121° C. 60 min. | 10 cans | 10 cans |
| 12 g/l Stock + 2 g/l Plasmal | 121° C. 60 min. | 10 cans | 10 cans |

TABLE 6

The results are as follows:

| | | | T-peel | NaCl | Scratch | VitC | Broth |
|---|---|---|---|---|---|---|---|
| A | Invention | TCCT/PET | 5.2 | ++ | 8 | ++ | ++ |
| E | Ref. TCCT | TCCT/PET | 4.5 | −− | 25 | −− | ++ |
| C | Ref. ECCS | ECCS/PET | 5.1 | + | 6 | ++ | ++ |
| B | Invention | TCCT/PP | 8.1 | + | 7 | ++ | ++ |
| D | Ref. ECCS | ECCS/PP | 10.8 | + | 5 | ++ | ++ |

The peel force is measured in N and is indicative for the adhesion of the polymer layer to the substrate. The results after two weeks were consistent with those after immediate opening, and these results show that the blackplate coated with a TCCT layer from an electrolyte with a complexing agent followed by the deposition of a chromium oxide layer from the same electrolyte without the complexing agent matches or even outperformed the current ECCS standard for a PET coated substrate.

The substrates were also subjected to lacquering tests. Four different lacquers were tested under three different conditions. The tests consisted of sterilisation trials of lacquered and cured samples (applied and cured according to the instructions of the lacquer suppliers) in a NaCl, a citric acid and a cysteine solution at 130° C. for an hour.

TABLE 7

The results of the lacquering tests.

| Epoxy | Cystein 0.5 g/l | | NaCl 3% | | Citric acid 1% | | BPA-NI polyester | Cystein 0.5 g/l | | NaCl 3% | | Citric acid 1% | |
|---|---|---|---|---|---|---|---|---|---|---|---|---|---|
| gold | Gt | d | Gt | d | Gt | d | white | Gt | d | Gt | d | Gt | d |
| A | 0 | 0 | 0 | 0 | 0 | 0 | A | 0 | 0 | 0 | 2 | 0 | 1 |
| E | 0 | 0 | 3 | 3 | 0 | 0 | E | 0 | 0 | 1 | 2 | 0 | 0 |
| C | 0 | 0 | 0 | 0 | 0 | 0 | C | 1 | 0 | 1 | 1 | 1 | 0 |
| BPA-NI | Cystein 0.5 g/l | | NaCl 3% | | Citric acid 1% | | Organosol | Cystein 0.5 g/l | | NaCl 3% | | Citric acid 1% | |
| gold | Gt | d | Gt | d | Gt | d | gold | Gt | d | Gt | d | Gt | d |
| A | 0 | 0 | 0 | 1 | 0 | 0 | A | 0 | 0 | 0 | 2 | 0 | 0 |
| E | 0 | 0 | 2 | 4 | 0 | 0 | E | 1 | 1 | 5 | 5 | 0 | 0 |
| C | 0 | 0 | 0 | 0 | 0 | 0 | C | 1 | 0 | 1 | 2 | 0 | 0 |

The adhesion (Gt) was tested according to the Gitterschnitt method on a flat part of the sample as described in ISO 2409:1992, $2^{nd}$ edition. A "0" means that the adhesion is perfect, "5" is bad.

A 5 mm Erichsen dome is applied for each lacquered panel and sterilisation medium/condition and the adhesion on the Erichsen dome is tested by tape only without incision.

These results clearly show that the variant A, the inventive example performs considerably better than the variant E, which is the same as A but without the chromium oxide coating according to the invention. It also shows that the variant A performs at par with the current Cr(VI)-variant (C), and even outperforms it for some combinations of lacquer and sterilisation medium/condition.

BRIEF DESCRIPTION OF THE DRAWINGS

The invention will now be explained by means of the following, non-limiting figures.

a: Blackplate b. TCCT®

Figure 1:
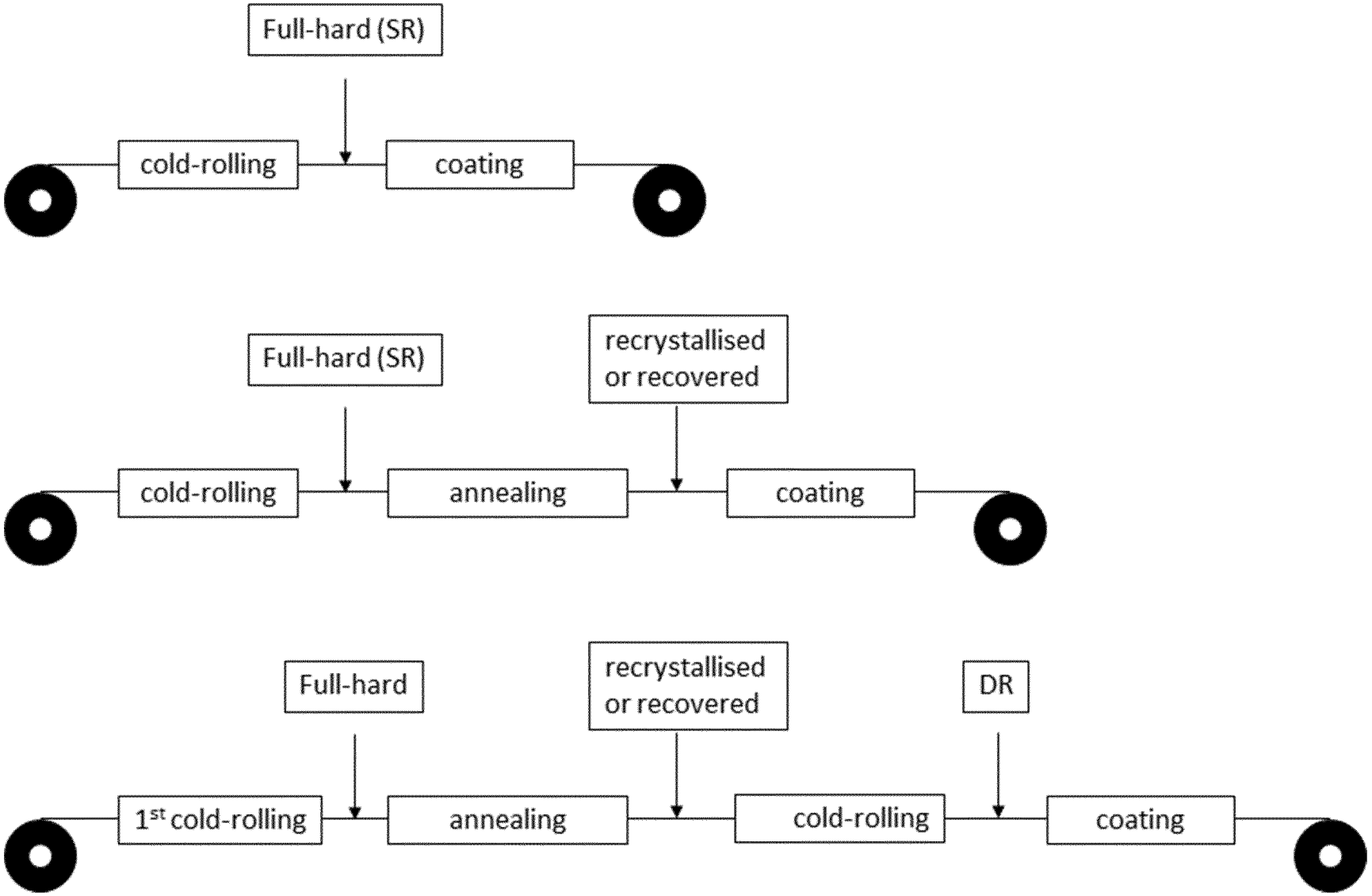
FIG. 1 schematically summarises the process steps to obtain the coated product, starting from a hot-rolled strip. Before cold-rolling, the hot-rolled strip is usually pickled (not shown) to remove the hot-rolling scale and cleaned (not shown) to remove any contaminants from the strip.
Figure 2:
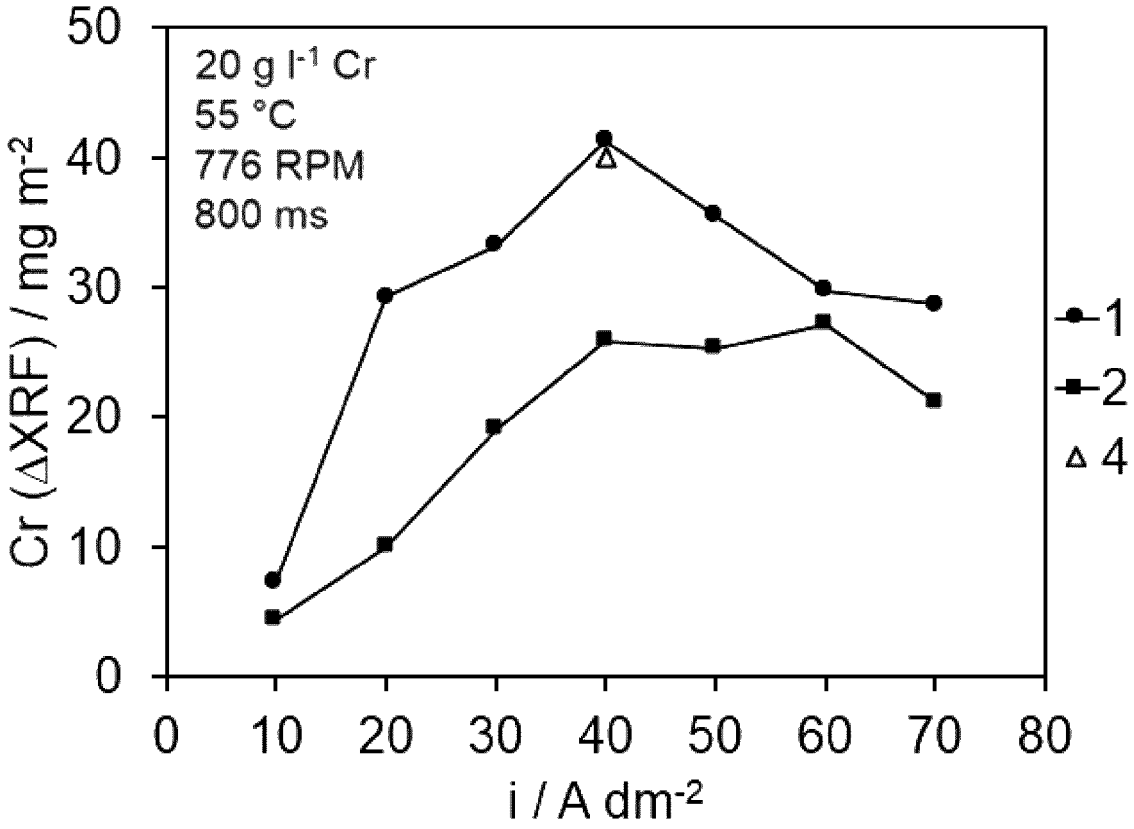
FIG. 2: Amount of Cr-oxide as a function of current density in RCE-experiments and in an industrial trial.
Figure 3:
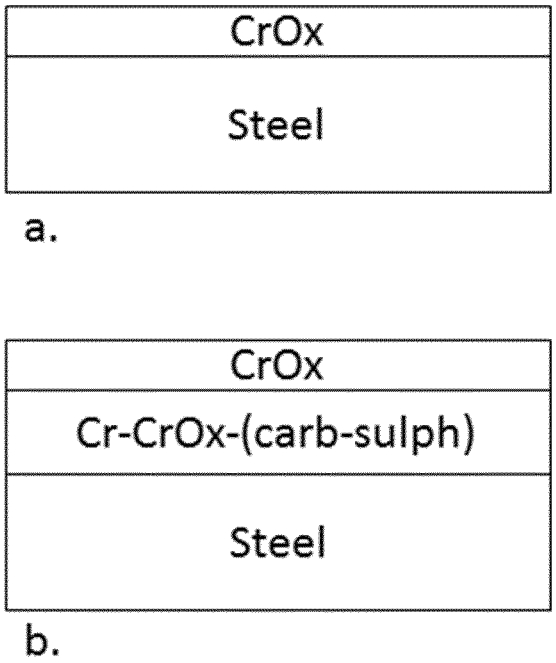
FIG. 3: schematic drawing of packaging steels producible with a top layer of CrOx deposited according to the invention.
Figure 4:
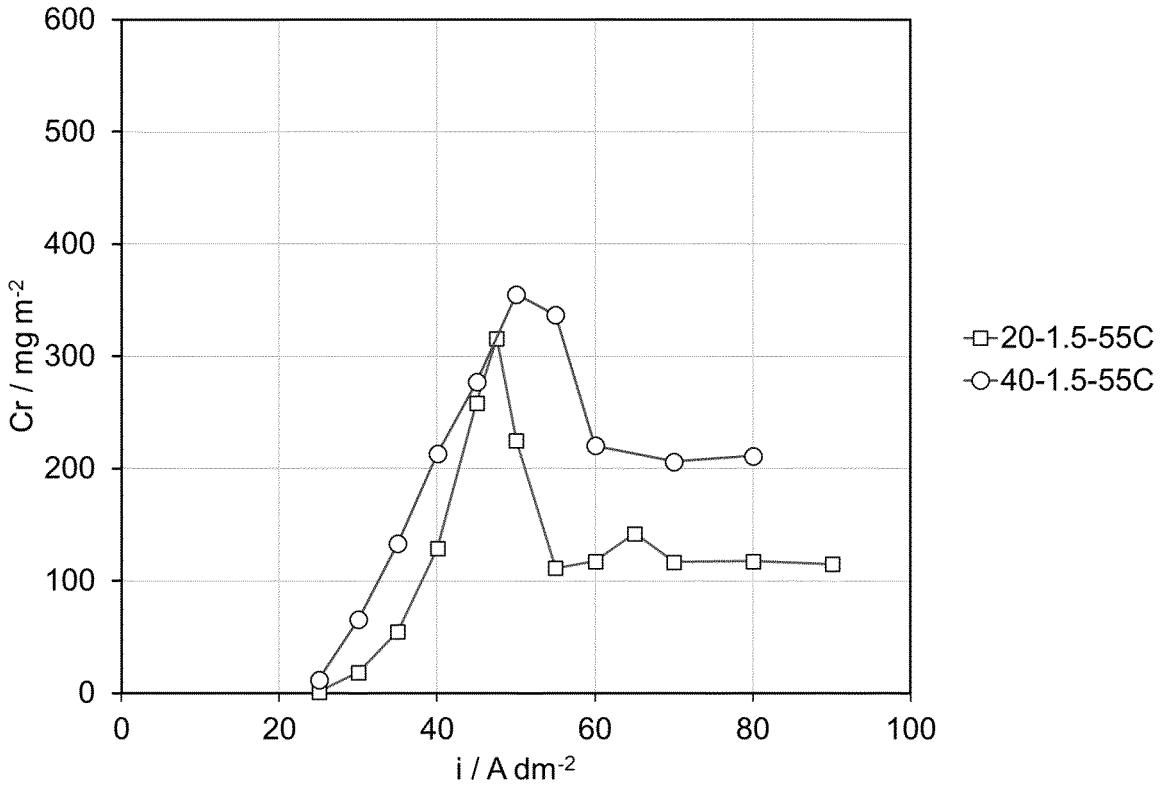

FIG. 4: The effect of the Cr(III) concentration on the deposition of Cr-metal in the metallic coating on the steel substrate. A doubling of the Cr(III) concentration from 20 to 40 g/l at a plating temperature of 55° C. and a formate/$Cr^{3+}$ molar ratio of 1.5 does not affect the onset of the Cr-deposition.

Figure 5:
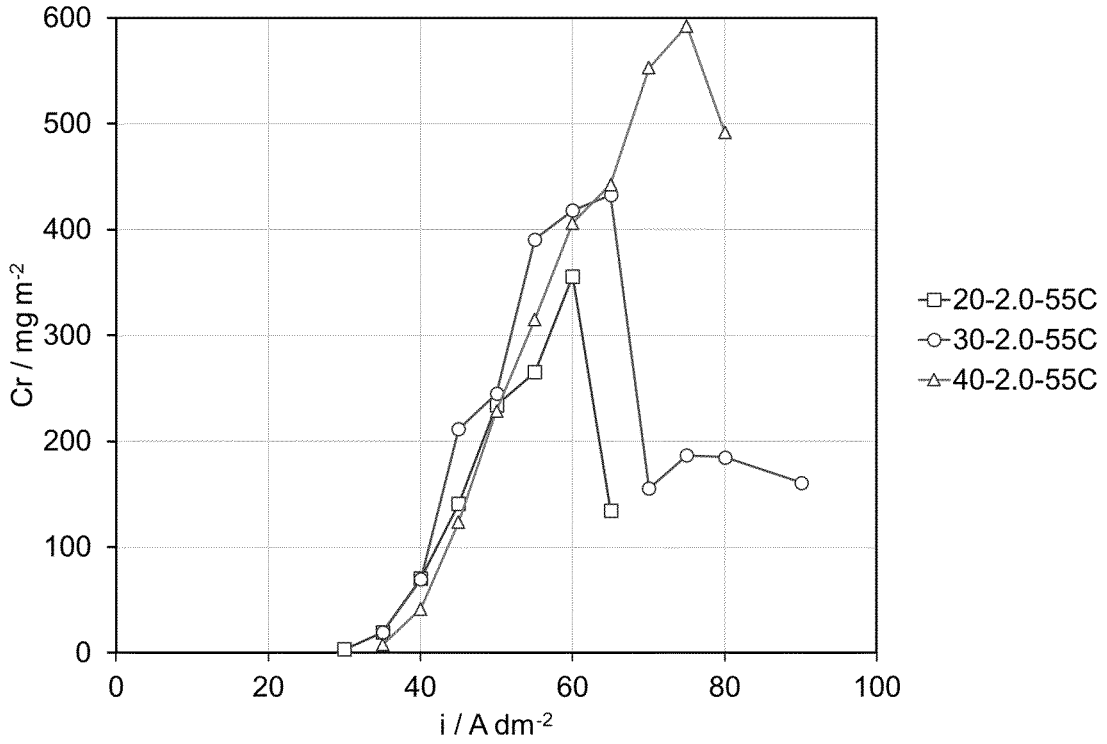

FIG. 5: The effect of the Cr(III) concentration on the deposition of Cr-metal in the metallic coating on the steel substrate at a formate/$Cr^{3+}$ molar ratio of 2.0 does not affect the onset of the Cr-deposition, and the plating window increases with the Cr-concentration.

Figure 6:
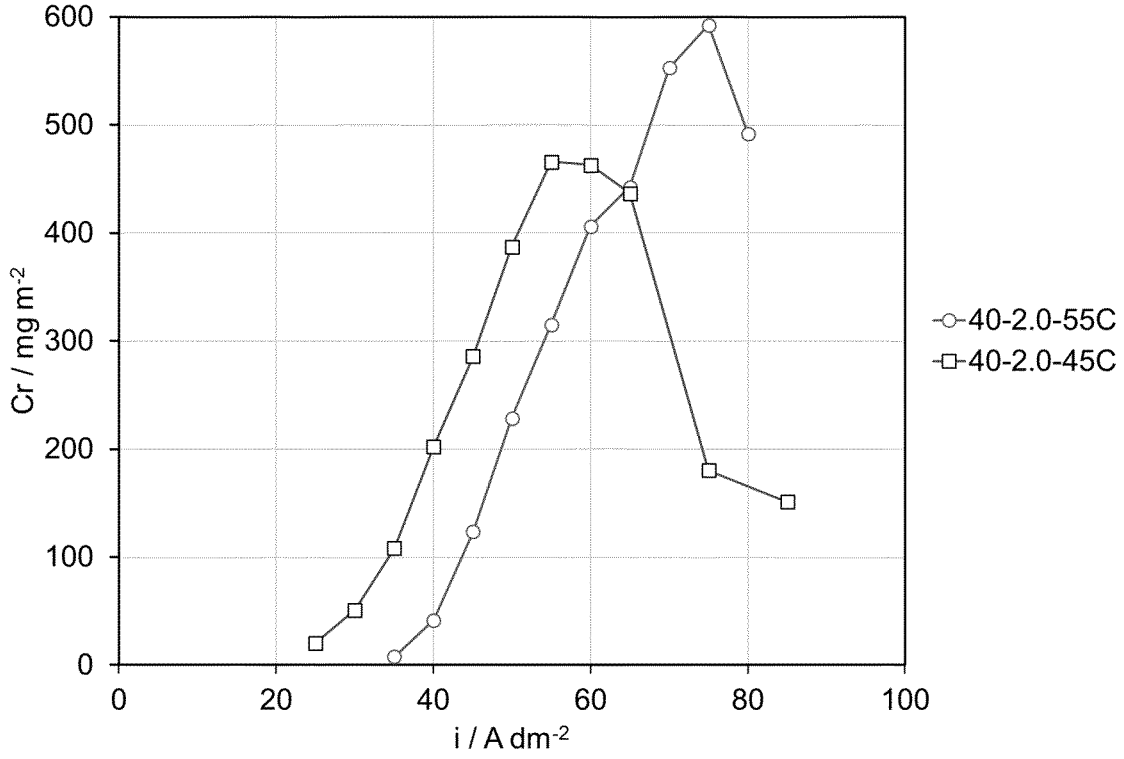

FIG. 6: The effect of lowering the plating temperature is an increased efficiency of the plating process. Plating takes place at a lower current density.

Figure 7:
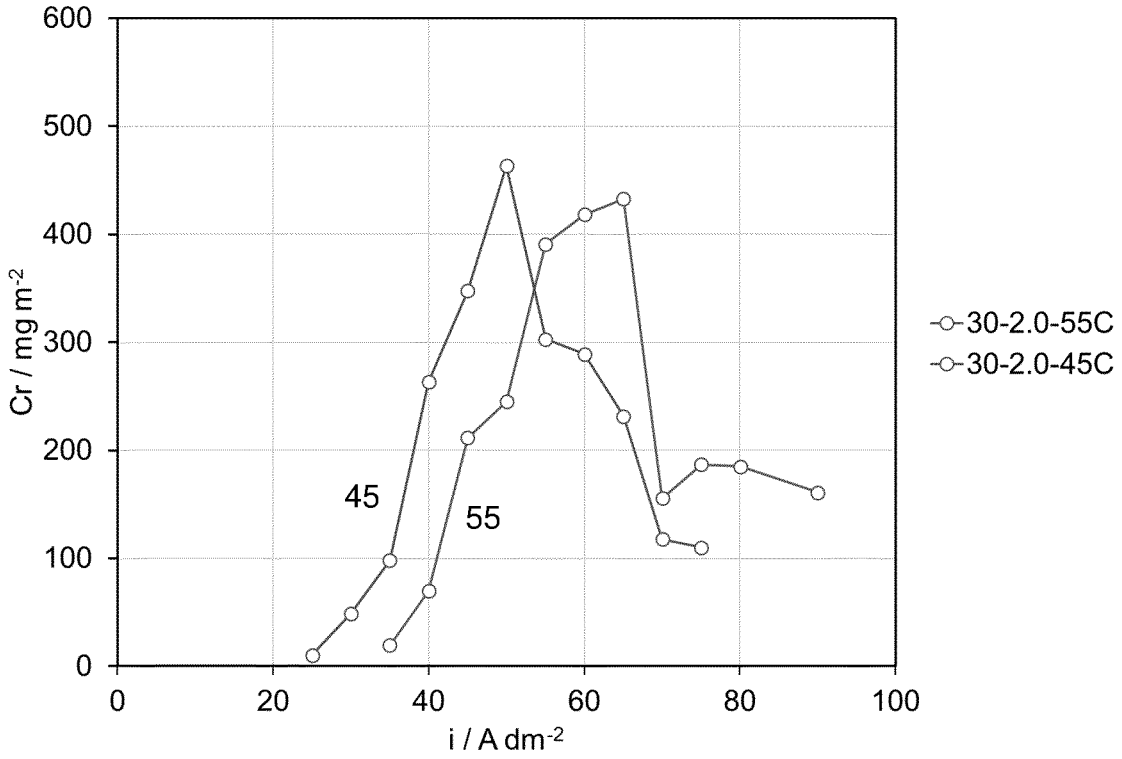

FIG. 7: The effect of lowering the plating temperature is an increased efficiency of the plating process. Plating takes place at a lower current density. Robustness of the higher plating temperature is somewhat higher.

The invention claimed is:

1. A method for electrolytically depositing a closed chromium oxide layer comprising:

depositing the closed chromium oxide layer onto a steel substrate, selected from blackplate or blackplate coated with a chromium electrodeposited coating produced on the basis of chromium(III) technology, in a continuous high speed deposition line operating at a line speed of at least 50 m/min from a halide-ion free aqueous electrolyte solution comprising a trivalent chromium compound provided by a water-soluble chromium(III) salt, wherein the steel substrate acts as a cathode and wherein an anode comprises a catalytic coating of i) iridium oxide or ii) a mixed metal oxide comprising iridium oxide and tantalum oxide, for reducing or eliminating the oxidation of $Cr^{2+}$ ions to $C^{6+}$ ions, and wherein the electrolyte solution contains at least 50 mM and at most 1000 mM $Cr^{3+}$ ions, a total of from 25 to 2800 mM of sodium sulphate or potassium sulphate, and there may be unavoidable impurities, wherein the electrolyte solution has a pH of between 2.50 and 3.6 measured at 25° C., and wherein the electrolyte solution has at most 10 mM of complexing agent as a said unavoidable impurity, and wherein a depositing temperature is between 40 and 70° C. and wherein no other compounds are added to the electrolyte solution, except optionally sulphuric acid or sodium hydroxide or potassium hydroxide to adjust the pH to a desired value, wherein at least 5 mg/$^2$ of chromium is deposited as chromium oxide.

2. The method according to claim 1, wherein the pH is adjusted to a value of 2.55 to 3.6.

3. The method according to claim 1, wherein a time of depositing the chromium oxide layer, being duration of application of electrical current to the cathode, is at most 1000 ms.

4. The method according to claim 1, wherein the water-soluble chromium(III) salt is basic chromium(III)sulphate.

5. The method according to claim 2, wherein the electrolyte solution contains at most 10 mM of sodium formate (NaCOOH) as an unavoidable impurity.

6. The method according to claim 1, wherein the electrolyte solution contains at most 10 mM of sodium formate (NaCOOH) as an unavoidable impurity.

7. The method according to claim 1, wherein the aqueous electrolyte solution contains at most 5 mM said complexing agent, said complexing agent comprising sodium formate (NaCOOH), as an unavoidable impurity.

8. The method according to claim 1, wherein the deposition temperature at least 50° C.

9. The method according to claim 1, wherein the line speed of the deposition line is at least 100 m/min.

10. The method according to claim 1, wherein the steel substrate is the blackplate coated with the chromium electrodeposited coating produced based on chromium(III) technology, wherein the chromium electrodeposited coating comprises a chromium electrodeposited coating layer on one or both sides, said chromium electrodeposited coating layer(s) comprising chromium metal and chromium oxide and optionally also one or more of chromium carbide and chromium sulphate, and wherein the chromium electrodeposited coating layer is deposited from an aqueous chromium electrodeposited coating layer electrolyte solution comprising a trivalent chromium compound, wherein the chromium electrodeposited coating layer electrolyte solution is free of chloride ions and of a boric acid buffering agent, the steel substrate acts as a cathode and an anode comprising a catalytic coating of iridium oxide or a mixed metal oxide for reducing or eliminating the oxidation of $Cr^{3+}$ ions to $Cr^{6+}$ ions, wherein the electrolyte solution contains at least 50 mM and at most 1000 mM $Cr^{3+}$ ions, a complexing agent at a $$\left(\frac{\text{complexing agent}}{Cr^{3+}}\right)$$

molar ratio of at least 1:1 and wherein the complexing agent is a formate, wherein the formate/$Cr^{3+}$ molar ratio is at most 2.5:1, 25 to 2800 mM of sodium sulphate ($Na_2SO_4$), a pH of between 1.5 and 3.6 measured at 25° C., and wherein the deposition temperature is between 30 and 70° C.

11. The method according to claim 1, wherein the steel substrate is further coated on one or both sides by a film lamination step or a direct extrusion step with an organic coating consisting of a thermoplastic single layer, or a thermoplastic multi-layer polymer.

12. The method according to claim 11, wherein the organic coating is a polymer coating system comprising one or more layers comprising thermoplastic resins selected from polyesters, polyolefins, acrylic resins, polyamides, polyvinyl chloride, fluorocarbon resins, polycarbonates, styrene type resins, ABS resins, chlorinated polyethers, ionomers, urethane resins and functionalised polymers; and/or copolymers thereof; and or blends thereof.

13. The method according to claim 12, wherein the organic coating on the one or both sides of the coated blackplate is a multi-layer coating system, said coating system comprising at least an adhesion layer for adhering to the coated blackplate, a surface layer and a bulk layer between the adhesion layer and the surface layer, wherein the adhesion layer, the surface layer and the bulk layer consist of polyethylene terephthalate, Isophthalic-modified polyethylene terephthalate, cyclohexanedimethanol-modified polyethylene terephthalate, polybutylene terephthalate, polyethylene naphthalate, or copolymers or blends thereof.

14. The method according to claim 1, wherein the pH is adjusted to a value of 3.25 to 3.6.

15. The method according to claim 1, wherein at least 6 $mg/m^2$ of chromium is deposited as chromium oxide.

16. The method according to claim 1, wherein at least 8 $mg/m^2$ of chromium is deposited as chromium oxide.

17. The method according to claim 1, wherein the aqueous electrolyte solution contains at most 845 mM of sodium sulphate.

18. The method according to claim 1, wherein the aqueous electrolyte solution contains 210 mM to 845 mM of sodium sulphate.

19. The method according to claim 1, wherein the aqueous electrolyte solution has an absence of buffering agent.

20. A method for electrolytically depositing a closed chromium oxide layer comprising:

depositing the closed chromium oxide layer onto a steel substrate, selected from blackplate or blackplate coated with a chromium electrodeposited coating produced on the basis of chromium(III) technology, in a continuous high speed deposition line operating at a line speed of at least 50 m/min from a halide-ion free aqueous electrolyte solution comprising a trivalent chromium compound provided by a water-soluble chromium(III) salt, wherein the steel substrate acts as a cathode and wherein an anode comprises a catalytic coating of i) iridium oxide or ii) a mixed metal oxide comprising iridium oxide and tantalum oxide, for reducing or eliminating the oxidation of $Cr^{3+}$ ions to $Cr^{6+}$ ions, wherein a depositing temperature is between 40 and 70° C., wherein the aqueous electrolyte solution consists of at least 50 mM and at most 1000 mM $Cr^{3+}$ ions, a total of from 25 to 2800 mM of sodium sulphate or potassium sulphate, a pH of between 2.55 and 3.6 measured at 25° C., and there may be unavoidable impurities, and optionally sulphuric acid or sodium hydroxide or potassium hydroxide to adjust the pH to a desired value, wherein at most 10 mM of complexing agent is present as a said unavoidable impurity, and wherein at least 6 $mg/m^2$ of chromium is deposited as chromium oxide.

* * * * *